United States Patent [19]

Campbell et al.

[11] 3,974,985

[45] Aug. 17, 1976

[54] WIDE ANGLE SEEKER

[75] Inventors: John M. Campbell, Ridgecrest; James W. Oestreich, China Lake, both of Calif.

[73] Assignee: The United States of America as represented by the Secretary of the Navy, Washington, D.C.

[22] Filed: May 18, 1972

[21] Appl. No.: 254,721

[52] U.S. Cl. ..... 244/3.16; 250/203 R

[51] Int. Cl.[2] ..... F41G 7/00; F42B 15/02

[58] Field of Search ..... 244/3.15, 3.16, 1.5 A; 250/203; 350/301, 302

[56] References Cited

UNITED STATES PATENTS

| | | | |
|---|---|---|---|
| 2,941,082 | 6/1960 | Carbonara et al. | 250/203 |
| 3,015,249 | 1/1962 | Taylor | 250/203 X |
| 3,180,587 | 4/1965 | Garner et al. | 244/1.5 A |
| 3,219,822 | 11/1965 | Kutzscher et al. | 250/203 R X |
| 3,293,437 | 12/1966 | Boydell | 244/3.16 |
| 3,617,016 | 5/1968 | Bolsey | 244/3.16 |

*Primary Examiner*—Harold Tudor
*Attorney, Agent, or Firm*—R. S. Sciascia; Roy Miller; Thomas W. Hennen

[57] ABSTRACT

A two axis, three gimbal tracker for use with a missile or the like. The tracker utilizes a lens barrel which has unlimited angular freedom in one axis, and more than 50° of angular freedom in the other axis, and is mounted to the side of the carrying vehicle.

4 Claims, 4 Drawing Figures

WIDE ANGLE SEEKER

BACKGROUND OF THE INVENTION

1. Field of the Invention.

This invention relates to target tracking devices for use in guided vehicles. More particularly, this invention relates to tracking devices for small guided missiles, torpedoes, and the like in which it is desirable to have the nose free for carrying paraphernalia other than the tracker, and in which it is sometimes desirable to find and lock on a target behind the carrying vehicle.

2. Description of the Prior Art.

The use of trackers in guided missiles and the like is well known. A typical prior art tracker is mounted in the nose of the carrying vehicle and comprises a lens system, a sensing unit and suitable electronics. An image of the target, which may be an actual optical image, a heat image or some other type of image depending upon the type of lens system and sensing unit, impinges on the sensing unit through the lens system. The sensing unit converts information received from the target image into signals which travel through the electronics and drive various servomechanisms which keep the tracker locked on the target and navigate the carrying vehicle toward the target.

In certain cases it is undesirable to mount a tracker in the nose of the carrying vehicle. For example, in a torpedo it is desirable to have a shaped charge or the like in the nose, and if the nose must be utilized to carry a tracker, it is naturally not available for mounting the charge. As another example, it is sometimes desirable to reduce the aerodynamic drag on a missile by designing the nose to come to a sharp, sleek point. If a tracker is to be mounted in the nose, a certain amount of area is required to contain it, and it is difficult to design the missle to have a pointed nose without compromising optical performance. Further, the physical limits of the nose of a missile, torpedo or the like restrict the movements of physical components of a tracker mounted therein, and generally limit the viewing area of the tracker to a small cone directly in front of the carrying vehicle.

In addition to the above-mentioned problems, many prior art trackers, and especially those designed to enlarge the viewing cone, are designed in a manner whereby image rotation occurs at the sensing unit. Image rotation at the sensing unit is undesirable because it complicates the electronics system which must be used, and because it introduces human factors problems for any person viewing a display screen or the like showing the target.

The use of domes to contain various target tracking devices is well known. For example, the famed "Flying Fortress" of World War II had several domes which contained guns and large trackers, the trackers being human beings. However, the use of domes as large as those used on a B-17 or similar aircraft on a guided missile, torpedo or the like, and the sending of a human being along to guide the missile or torpedo to its target would be rather impractical to say the least. In fact, with small missiles, i.e., missiles having diameters of about 24 inches or less, the results obtained from using any external paraphernalia whatsoever (excepting necessary external paraphernalia such as fins) must be very carefully weighed against the adverse aerodynamic effects which might be produced. And, since certain equipment which must necessarily be used in automatic trackers has not been miniaturized to the point where it can be conveniently placed in a small dome which would have inconsequential drag effects on a missile or the like, dome mounted trackers have heretofore not been used on small diameter missiles or the like.

SUMMARY OF THE INVENTION

It has now been found that by using the two axis, three gimbal tracker described below, the lens system of the tracker can be mounted in a dome at the side of the carrying vehicle, and the diameter of the dome can be held to about 3 inches or less. The small size of the dome insures that the dome will produce only minimal drag effects on a missile or torpedo, and the described tracker has certain other added benefits. Among the added benefits are those of (1) freeing the nose of the carrying vehicle so that a warhead, alternate tracker, fuze or the like can be mounted in it, (2) permitting the easy use of a pointed nose on the vehicle if desired, (3) providing a tracker which can detect targets behind as well as in front of the vehicle, and (4) providing a wide angle tracker in which no image rotation occurs at the sensing unit. These and other advantages will become apparent from the description of the preferred embodiments.

DESCRIPTION OF THE PREFERRED EMBODIMENTS

Figure 1:
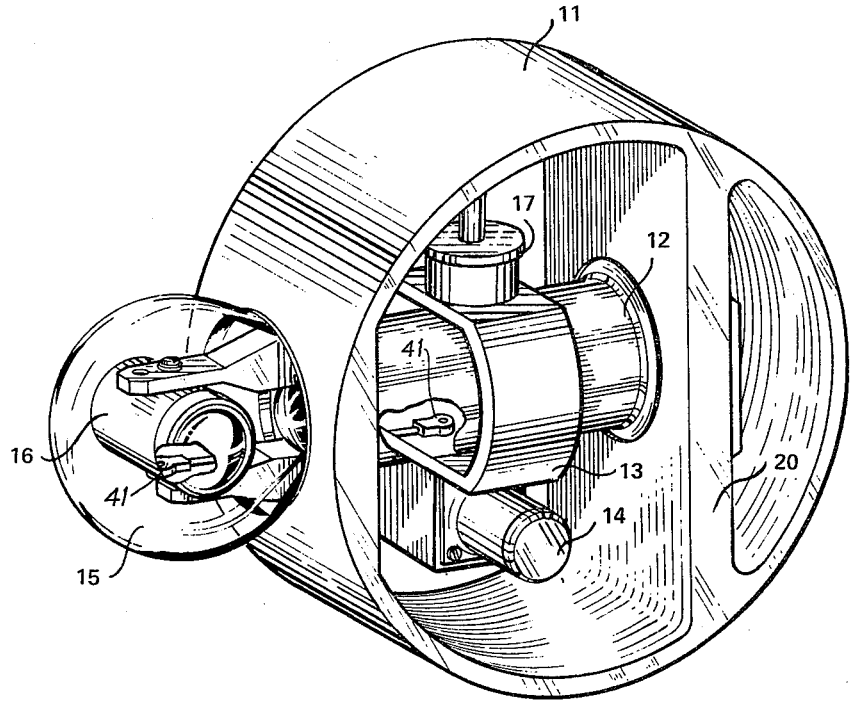
FIG. 1 is a perspective view of a tracker according to this invention.

Going first to the drawing in which like numerals are used to indicate like parts, the several Figures will be described as if the tracker were strictly for use in a small guided missile, i.e., one having a diameter of from about 24 to 8 inches or less. However, it should be realized that the invention could easily be adapted for use in underwater vehicles such as torpedoes and the like or for space vehicles other than missiles.

FIG. 1 is a perspective view of a seeker according to this invention mounted in a tubular section of the frame 11 of a missile located aft of the missile's nose. A turret 12 is mounted in the frame with one end rotatable in an opening in a partition 20 which divides the frame longitudinally, and the other end projecting rotatably through an opening in the outer wall of the frame. The turret is attached to the partition and outer wall through precision ball bearings. Rotatably attached to the turret inside the frame is an auxiliary gimbal 13. The auxiliary gimbal 13 carries a gyro or gyros 14 and is moved angularly by a torque motor 17 whose motion is measured by an angle transducer generally indicated at 17'. The turret is, in a like manner, driven by a torque motor (not shown) and measured by an angle transducer located within partition 20. The gyro system may be either a single two axis rate gyro, two single axis rate gyros or a free gyro.

Rotatably attached to the end of turret 12 which projects outside of frame 11 is a lens barrel 16 which carries the lens system of the tracker. The lens barrel is covered by a dome 15 which is a hyperhemisphere of optical glass rigidly attached to the frame. As stated above, it is preferable that the dome have a diameter of about 3 inches or less if the tracker is to be used with small missiles having diameters of about 24 inches or less. Therefore, while the only limits placed on rotation of the lens barrel in a plane parallel to the longitudinal axis of the missile are due to electrical flex leads (not shown) leading from the turret, the missile body places some restriction on inward and outward angular motion of the lens barrel. It has been found that if a line running along the longitudinal axis of the lens barrel parallel to the longitudinal axis of the missile is considered to be the neutral position, and the lens barrel is placed in a three inch diameter dome, an inward angular movement of approximately 12° and an outward angular movement of approximately 45° can be obtained. This yields a sight line envelope which is an angular wedge having dimensions of approximately 57° × 360° or more. The inward and outward motion of the lens barrel is directed by a push rod 41 connected between the lens barrel and the auxiliary gimbal which runs under the bearings attaching the turret to the outer wall of the frame.

The turret 12 is hollow and has the sensing unit of the tracker mounted within it. The sensing unit which may be a vidicon, IR detector, etc., depending upon the type of lenses used, is mounted in a manner whereby it rotates when the turret rotates. Thus, no image rotation occurs at the sensing unit in a tracker according to this invention.

Naturally, a certain amount of electrical wiring must lead from the sensing unit to various servomechanisms of the tracker and missile. The wiring is not shown in FIG. 1 because a wide choice exists as to where it can be located, and as to techniques for doing the actual wiring. However, it has been found that with existing materials and techniques, it is preferable to use some stop mechanism to prevent the turret from rotating more than about 720°. That is, if the turret is allowed to rotate more than about 720° in one direction, the length of wiring necessary makes the amount of wiring too voluminous for use in small missiles. Furthermore, turret rotation of only as much as 360° will enable the tracker to lock on and follow a target behind the missile, above the missile, below the missile or in front of the missile. As in the case of the wiring, there are many suitable stop mechanisms and techniques available to control the angular rotation of the turret and prevent the turret from rotating more than a predetermined number of degrees before reversing.

Figure 2:
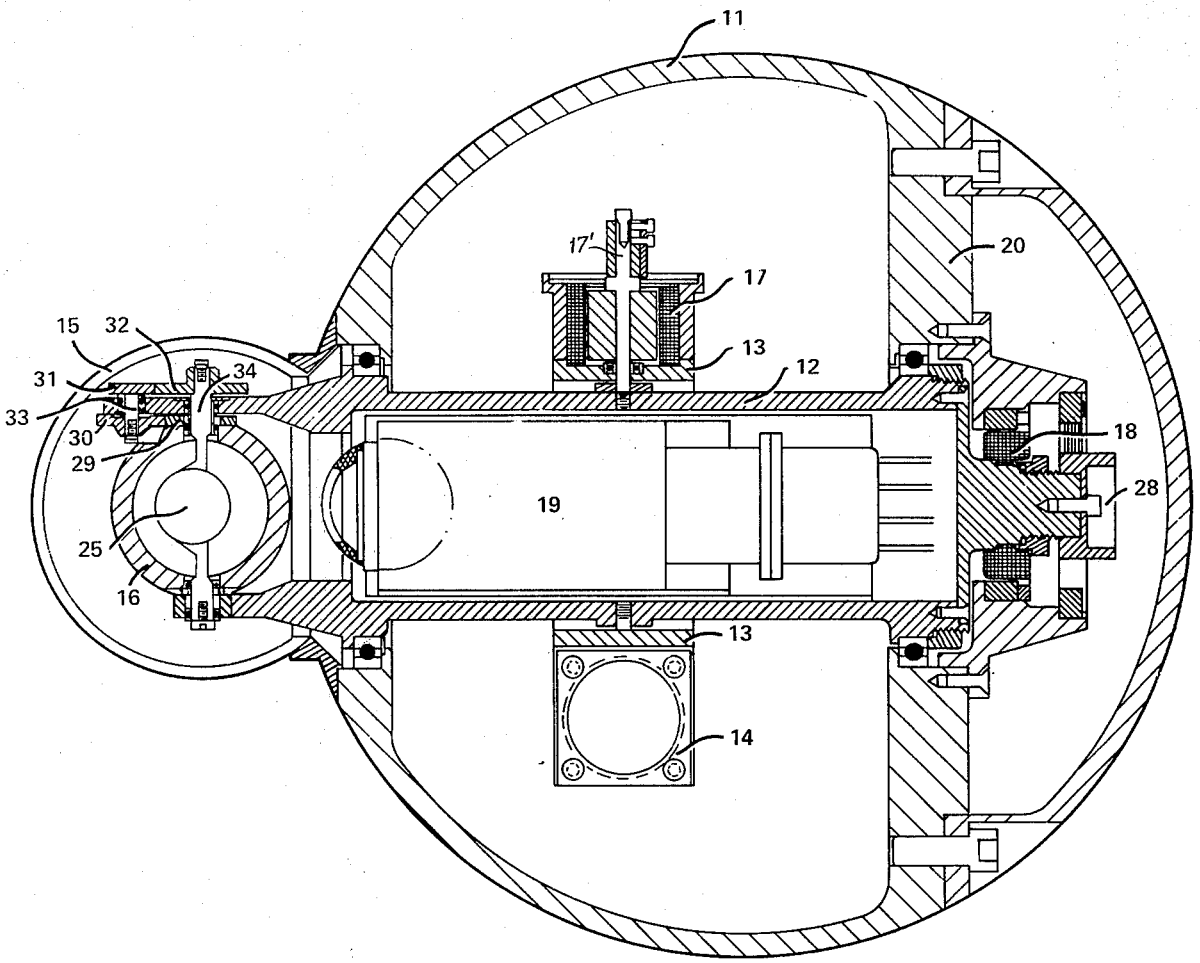
FIG. 2 is a cross sectional view of the tracker of FIG. 1.

FIG. 2 is a cross sectional view of the seeker of FIG. 1 further depicting how the various parts are assembled. FIG. 2, in addition to showing all the parts of FIG. 1, shows the location of the torque motor 18 which drives turrets 12, and of the sensor 19 inside of turret 12. In FIG. 2 the sensor is shown as being a vidicon. However, as stated above, it should be realized that what type of sensor is used depends upon the type of lens system. The numeral 28 indicates an angular transducer which measures the angle that the lens barrel is off from a predetermined zero position.

Figure 3:
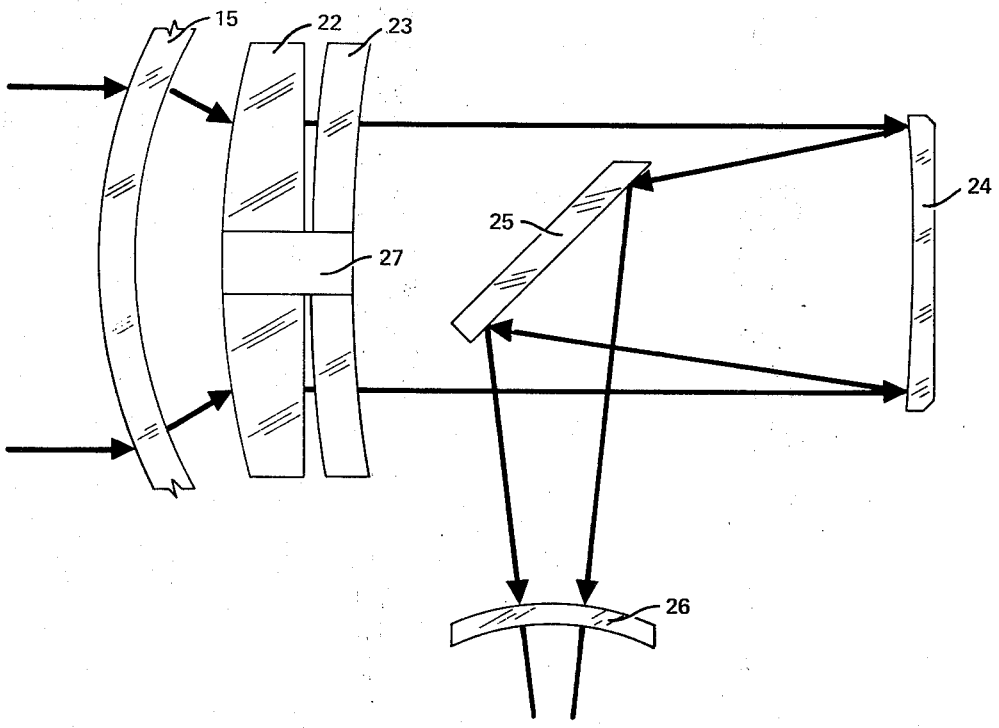
FIG. 3 is a plan view of a lens system suitable for use in the tracker of FIG. 1.

FIG. 3 is a plan view of a lens system suitable for use with a vidicon. Light entering the lens barrel enters through dome 15, passes through two refracting lenses 22, 23 and onto a spherical concave mirror 24. The mirror directs the light to a movable secondary mirror 25 which, in turn, directs it to the sensor through lens

26. The secondary mirror 25 is linked to the lens barrel through a half-angle mechanism (not shown in FIG. 3). The half-angle movement of the secondary mirror insures that the target image will continue to be fixed on the sensor as the lens barrel or inner gimbal sweeps through its 50°+ of arc. A sun detector mounted at 27 controlling an optical shutter mounted on the turret acts to prevent damage to the sensor which could be caused by the image of the sun on the detector. This is to protect the vidicon prior to launching. This feature may be utilized or not utilized depending on the environment in which the tracker is used.

A half angle mechanism suitable for driving the secondary mirror 25 of FIG. 3 is depicted in FIG. 2. The mechanism comprises four pulleys 29, 30, 31 and 32 interconnected by string belts, an idler shaft 33 connecting pulleys 30 and 31 and a mirror shaft 34 connecting pulley 32 with secondary mirror 25. Pulley 29 is connected to lens barrel 16 and rotates when the lens barrel rotates. The rotation of pulley 29 causes pulley 30 to rotate because of the belt connecting the two. When pulley 30 rotates, idler shaft 33 which is attached to it rotates. This, in turn, causes pulley 31 which is also connected to the idler shaft to rotate. Pulley 31 is connected to pulley 32 by means of a belt and, therefore, pulley 32 rotates when pulley 31 rotates. Pulley 32 is, in turn, connected to secondary mirror 25 through mirror shaft 34 and the secondary mirror rotates when pulley 32 rotates. The size ratio among the pulleys is chosen so that secondary mirror 25 rotates only one half as many degrees as the lens barrel. It will be recognized that half-angle mechanisms other than the one described could be used.

Figure 4:
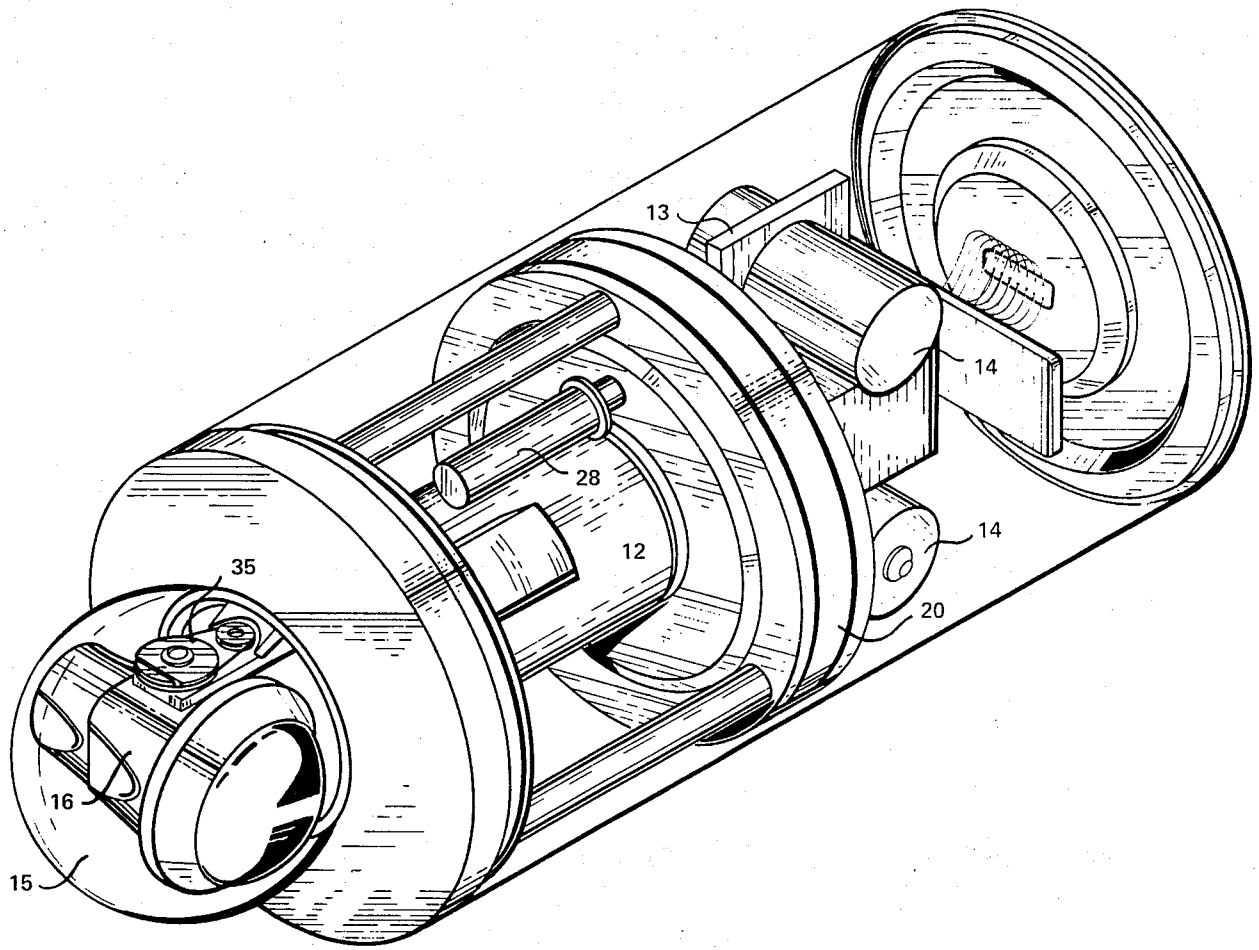
FIG. 4 is a perspective view of a tracker similar to that of FIG. 1 representing a second embodiment of the invention.

FIG. 4 depicts a second embodiment of the invention in perspective. The embodiment depicted in FIG. 4 is similar to that depicted in FIG. 1 in that the same parts are used. The arrangement shown in FIG. 4 differs from that in FIG. 1 in that the FIG. 4 tracker is constructed in a manner whereby it may be plugged into a suitable receptacle in the frame of a missile or the like at any time prior to firing. FIG. 4 also depicts a portion of the half-angle mechanism generally indicated as numeral 35 which moves secondary mirror 25 depicted in FIG. 3.

For clarity, it should be stated in summary that the lens barrel may be considered to be the inner gimbal of the above-described tracker, and that the turret may be considered to be the outer gimbal.

We claim:

1. A tracker mounted on a body having a longitudinal axis;

said body having an opening therein on an axis perpendicular to said longitudinal axis;

said body having a cross section and a dimension related to the cross section;

said tracker comprising:

a turret rotatably mounted in said opening for rotation about the axis perpendicular to said longitudinal axis of said body;

a lens barrel rotatably mounted at one end of said turret so that said barrel is completely outside said opening in the body;

said lens barrel being rotatable about an axis perpendicular to said axis of said opening;

an auxiliary gimbal pivotally attached to said turret in said body;

means for pivoting said auxiliary gimbal about an axis;

a pushrod having first and second ends, pivotally attached on said first end to said auxiliary gimbal at a location spaced from said gimbal pivot axis, and pivotally attached on said second end to said lens barrel at a location spaced from said lens barrel rotation axis;

a lens system contained in said lens barrel; and sensing means located within said turret in said body in a manner whereby said sensing means rotates when said turret rotates and receives images from said lens system.

2. A tracker according to claim 1 wherein said lens barrel is rotatable through an angle of approximately 57°.

3. A tracker according to claim 1 wherein said turret can rotate through an angle in excess of 360°.

4. A tracker according to claim 1 and further including;

protective means covering said lens means transparent to wavelengths at frequencies to which the sensing means will respond;

said protective means being dimensioned such that its largest dimension is several orders of magnitude less than the dimension related to the cross section of said body.

* * * * *